US007543765B1

(12) United States Patent
Elling

(10) Patent No.: US 7,543,765 B1
(45) Date of Patent: Jun. 9, 2009

(54) SELF UNLOADING PULL-TYPE TRAILER

(76) Inventor: Brad Elling, 5272 Lippincott, Lapeer, MI (US) 48446

( * ) Notice: Subject to any disclaimer, the term of this patent is extended or adjusted under 35 U.S.C. 154(b) by 219 days.

(21) Appl. No.: 11/140,278

(22) Filed: May 27, 2005

(51) Int. Cl.

| | |
|---|---|
| ***A01C 3/06*** | (2006.01) |
| ***A01C 7/00*** | (2006.01) |
| ***A01C 15/00*** | (2006.01) |
| ***A01C 19/00*** | (2006.01) |
| ***E01C 19/20*** | (2006.01) |
| *F04B 17/06* | (2006.01) |

(52) U.S. Cl. ..... 239/663; 239/664; 239/670; 239/675; 239/677; 222/626

(58) Field of Classification Search ..... 239/658, 239/664, 670–675, 679, 689; 222/626; 366/186, 366/195, 182.1; 414/504, 502, 523, 528; 198/316.1, 588, 583, 614
See application file for complete search history.

(56) References Cited

U.S. PATENT DOCUMENTS

| | | | | | |
|---|---|---|---|---|---|
| 1,700,294 | A | * | 1/1929 | Levin | 299/45 |
| 2,538,961 | A | * | 1/1951 | Biszantz et al. | 239/664 |
| 2,786,655 | A | | 3/1957 | Cowsert | |
| 3,037,780 | A | | 6/1962 | Skromme et al. | |
| 3,159,296 | A | | 12/1964 | Schultemaker | |
| 3,235,107 | A | * | 2/1966 | Tift | 239/675 |
| 3,520,434 | A | * | 7/1970 | Benchoff et al. | 414/502 |
| 3,561,681 | A | * | 2/1971 | Tyler | 239/663 |
| 3,613,926 | A | * | 10/1971 | Scroggins | 414/503 |
| 3,837,538 | A | | 9/1974 | Wiegelmann | |
| 3,873,032 | A | | 3/1975 | Jellis, Jr. | |
| 4,467,967 | A | * | 8/1984 | Martin | 239/662 |
| 4,478,369 | A | | 10/1984 | Von Holten | |
| 4,700,895 | A | | 10/1987 | Takata | |
| 5,090,627 | A | * | 2/1992 | Clevenger et al. | 239/675 |
| 5,409,344 | A | * | 4/1995 | Tharaldson | 414/505 |
| 5,538,388 | A | * | 7/1996 | Bergkamp et al. | 414/523 |
| 5,671,891 | A | * | 9/1997 | Keenan et al. | 239/676 |
| 6,283,697 | B1 | | 9/2001 | Pierce et al. | |
| 6,422,490 | B1 | * | 7/2002 | Truan et al. | 239/659 |

* cited by examiner

*Primary Examiner*—Len Tran
*Assistant Examiner*—James S Hogan
(74) *Attorney, Agent, or Firm*—Young Basile

(57) ABSTRACT

An improved self-unloading spreader has a front end, a back end, and sides defining walls of a container for holding material. The container has at least one opening in one of the walls through which material can move. Inside of the container, longitudinally disposed between the front end and the rear end, is an auger that can move material in the container to and through the opening. Also inside of the container, adjustably positioned above the auger, is an adjustable height baffle to control the amount of material the auger has available to move. Outside of the container, adjacent to the opening, is a transversely mounted conveyer belt for spreading material that flows through the opening. An hydraulic system powers the auger and allows the hydraulically powered auger to either move material towards the opening or away from the opening. The auger, in combination with the adjustable height baffle, controls the rate at which material is provided to the conveyer system. A power-take-off system transfers power to a gear box system that allows bi-directional movement of the transversely mounted conveyer belt so the conveyer system can spread material to either side of the spreader. The speed of the power-take-off system controls the distance to which the conveyer system throws the material to be spread.

13 Claims, 6 Drawing Sheets

SELF UNLOADING PULL-TYPE TRAILER

FIELD OF THE INVENTION

The present invention relates to self-unloading spreaders and more particularly to a self-unloading spreader in which the rate at which material is spread and the distance material is thrown are independently controllable. In addition the direction in which material is thrown can be easily changed.

BACKGROUND OF THE INVENTION

Self-unloading spreaders for materials such as rocks, sand, salt, soil, mulch, and the like are well known. Some are self-powered, such as the spreader disclosed in U.S. Pat. No. 3,235,107 (Tift). Others are meant to be towed and/or powered by another vehicle such as the spreaders disclosed in U.S. Pat. Nos. 3,520,434 (Destefan, et al), 3,037,780 (Skromme et al) and 3,159,296 (Schuitemaker). These spreaders have material moving systems with single power systems such as hydraulics or by the power-take-off of a towing vehicle but not a combination of both. This limits the options an operator of any of these systems has to vary the material spread rate and the throw distance; i.e. the operator can increase these together or decrease these together but not increase/decrease them separately. If the operator provides more power to the spreader to spread more material, the spreader will also throw the material a farther distance from the spreader. If the operator reduces the material flow rate then he also reduces the throw distance.

Another problem conventional spreaders have is they either spread material to both sides of the spreader at once, as does the rotational spreader in U.S. Pat. No. 3,235,107 (Tift), or they are uni-directional and spread material to only one side, as in U.S. Pat. Nos. 3,520,434 (Destefan, et al), 3,037,780 (Skromme et al) and 3,159,296 (Schuitemaker) and 2,786,655 (Cowsert). However, it is often advantageous to be able to spread material to only one side of the spreader at one time and then to be able to spread material to just the other side of the spreader a few moments later without having to totally reposition the spreader. With the spreaders mentioned above, an operator either spreads material to both sides at once, as with the rotational spreader, or would have to turn the entire spreader around to spread material in the other direction, as with the uni-directional spreaders.

SUMMARY OF THE INVENTION

It is an object of the present invention to provide an improved self-unloading spreader that allows an operator more flexibility in selecting material flow rate while also letting the operator independently decide how far to throw the material. In general, this is a accomplished by providing a spreader with two independently controllable power sources: one for controlling material flow/spread rate (quantity) and another for controlling material throw distance.

It is a further object of the present invention to provide an improved self-unloading spreader that can spread material to only one side of the spreader at one time and then to be able to spread material to just the other side of the spreader a few moments later without an operator having to totally reposition the spreader In one illustrative embodiment of the present invention the improved self-unloading spreader has a container for holding material. The container has at least one opening through which material can flow. Inside of the container is a material moving means that can move material in the container to and through the opening. Outside of the container, adjacent to the opening, is a material spreading means for spreading material that flows through the opening. An hydraulic system powers the material moving means and a power-take-off system powers the material spreading means.

In another feature of the illustrative embodiment of the present invention the improved self-unloading spreader has a front end, a back end, and sides defining walls of a container for holding material. The container has at least one opening in one of the walls through which material can move. Inside of the container, longitudinally disposed between the front end and the rear end, is an auger that can move material in the container to and through the opening. Also inside of the container, adjustably positioned above the auger, is an adjustable height baffle to control the amount of material the auger has available to move. Outside of the container, adjacent to the opening, is a conveyer belt for spreading material that flows through the opening. An hydraulic system powers the auger and a power-take-off system powers the conveyer belt.

In yet another feature of the illustrative embodiment of the present invention the improved self-unloading spreader has a front end, a back end, and sides defining walls of a container for holding material. The container is smaller at an enclosed bottom than it is at an open top area. The container has at least one opening in one of the walls through which material can move. Inside of the container, longitudinally disposed between the front end and the rear end, is an auger that can move material in the container to and through the opening. Also inside of the container, adjustably positioned above the auger, is an adjustable height baffle to control the amount of material the auger has available to move. Outside of the container, adjacent to the opening, is a transversely mounted conveyer belt for spreading material that flows through the opening. An hydraulic system powers the auger and allows the hydraulically powered auger to either move material towards the opening or away from the opening. The auger, in combination with the adjustable height baffle, controls the rate at which material is provided to the conveyer system. A power-take-off system transfers power to a gear box system that allows bi-directional movement of the transversely mounted conveyer belt so the conveyer system can spread material to either side of the spreader. The speed of the power-take-off system controls the distance to which the conveyer system throws the material to be spread.

Other advantages and embodiments of the present invention will become more apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

The following descriptions are of an exemplary embodiment only, and are not intended to limit the scope, application of configuration of the invention in any way. Rather, the following descriptions provide a convenient illustration for implementing exemplary embodiments of the invention. Various changes to the described embodiment may be made in the function and arrangement of the elements described without departing from the scope of the invention as set forth in the claims.

Figure 1:
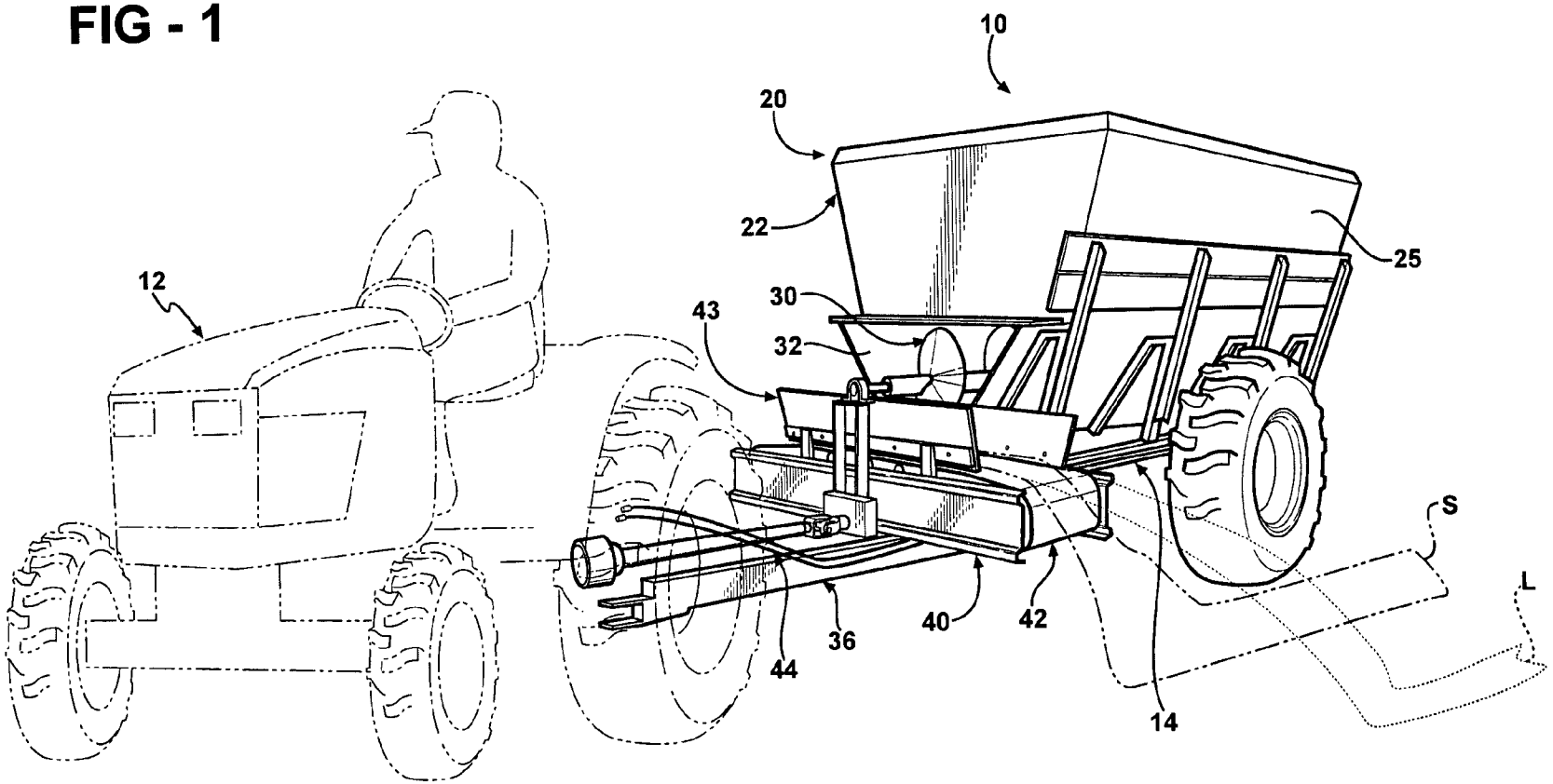
FIG. 1 is a perspective view of the front-end conveyer system embodiment of the improved self-unloading spreader of the present invention showing the improved self-unloading spreader being pulled by a tractor.
Figure 2:
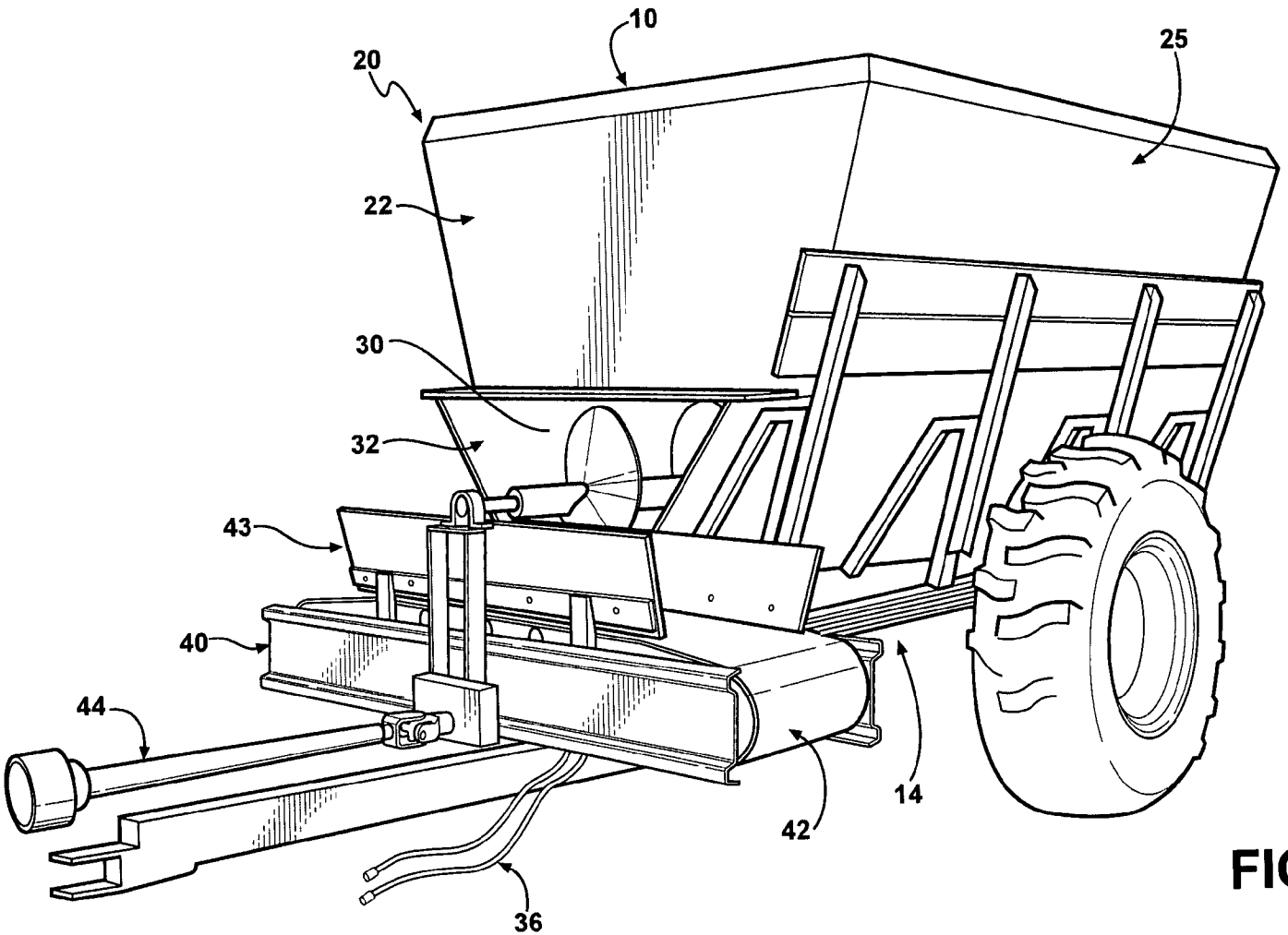
FIG. 2 is a perspective view of the front side of the front-end conveyer system embodiment of the improved self-unloading spreader of the present invention showing the conveyer system.
Figure 3:
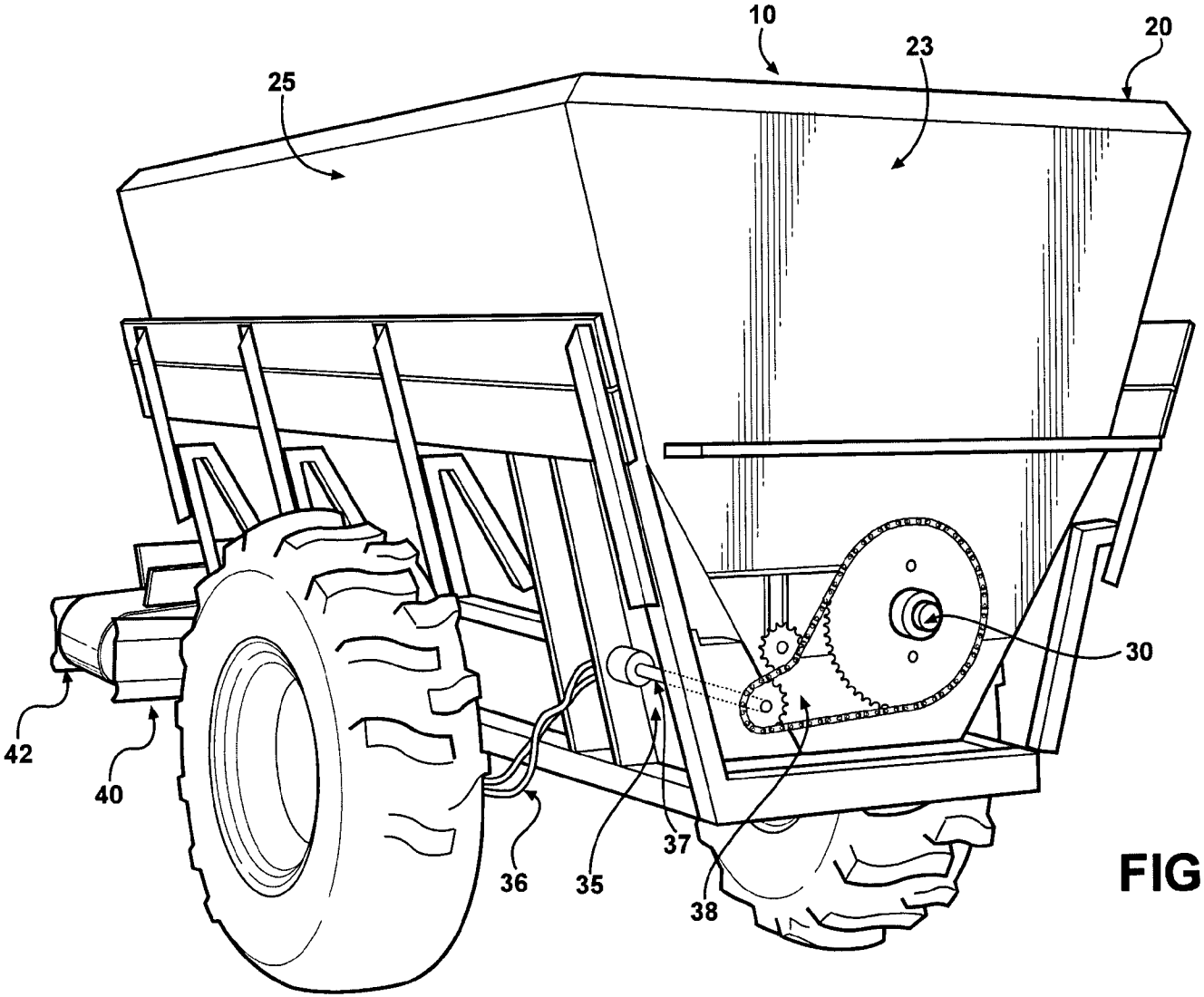
FIG. 3 is a perspective view of the rear side of the front-end conveyer system embodiment of the improved self-unloading spreader of the present invention showing the hydraulic drive system.
Figure 4:
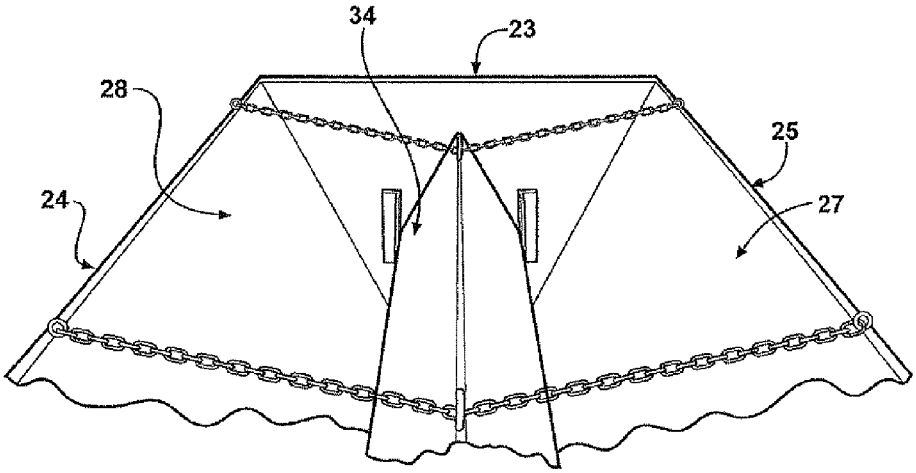
FIG. 4 is a perspective, cut-away view of the container of the improved self-unloading spreader of the present invention showing the adjustable height baffle.

Referring to FIGS. 1 and 2, there is shown an improved self-unloading spreader 10 of the type usually pulled by a tractor 12 (though the spreader could be self-powered as well). The self-unloading spreader 10 has a frame 14 upon which is mounted a container 20 that can contain material that needs to be spread such as dry sand, small stone, topsoil, mulch and many other types of material. The container 20 has a front end wall 22, a read end wall 23, two side walls 24 and 25 and a bottom 26. Together these walls define a container space 27 to contain material. The top area 28 is generally open to allow easy loading of the spreader, but it may include a removable covering to protect the material from the elements. The front end wall 22 and the rear end wall 23 are generally perpendicular to the bottom 26, as shown in FIG. 2, but the side walls 24 and 25 are sloped at an angle so the bottom 26 has less surface area than does the top area 28.

Figure 6:
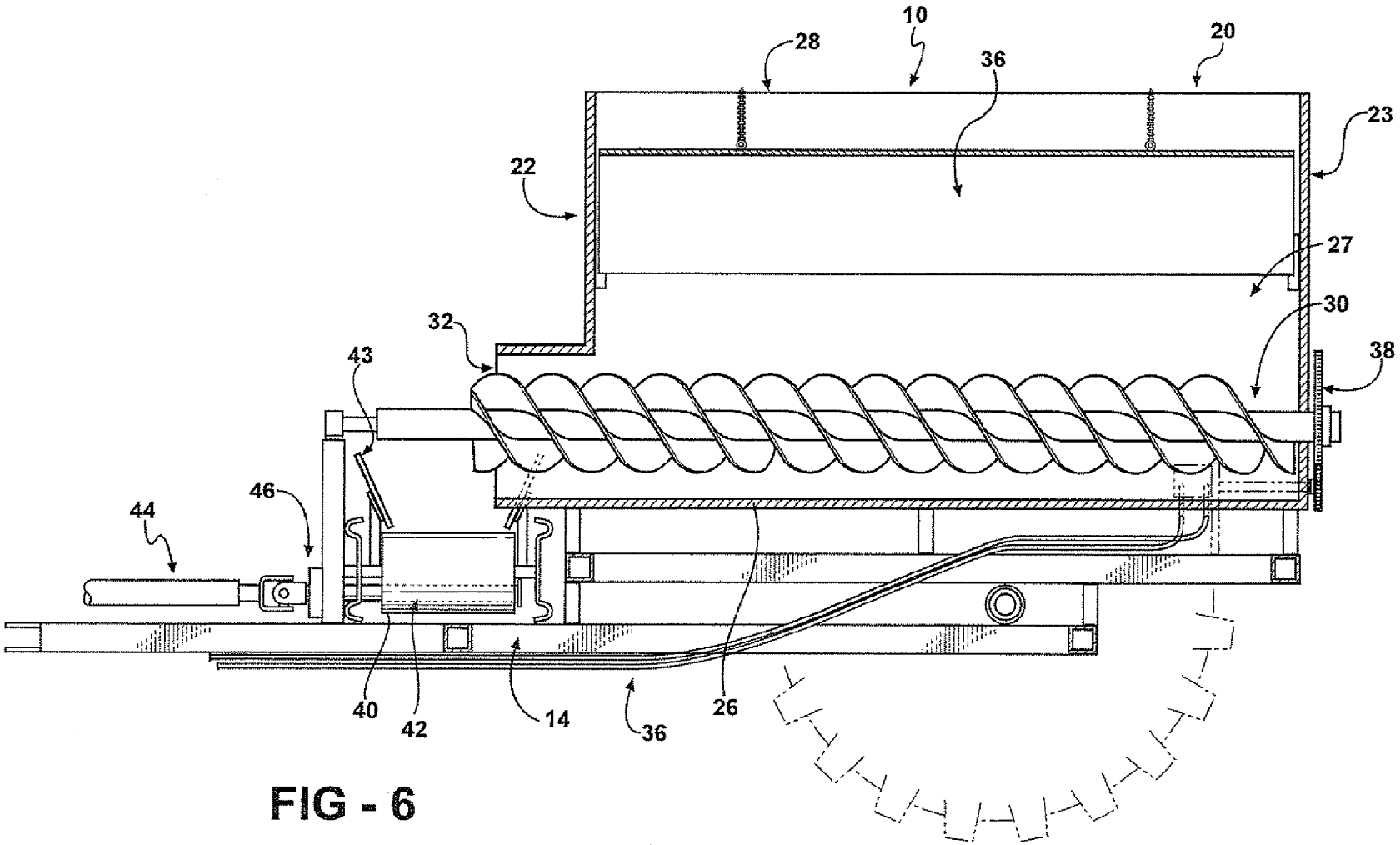
FIG. 6 is a cut-away side view of the front-end conveyer system embodiment of the improved self-unloading spreader of the present invention.

The self-unloading spreader 10 includes an independently-controllable auger 30 inside of the container 20 to move material within the container space 27. In the preferred embodiment the auger 30 is spiral shaped, as shown in FIG. 6 and is longitudinally disposed within the open space 27 between the front end wall 22 and the rear end wall 23. However, the auger 30 may be in any configuration and disposed in any direction or the auger 30 could even be replaced with a conveyer belt or a beater system (not shown) as long as it generally moves material towards and through an opening 32 in one of the walls. The auger 30 is driven by an hydraulic system, preferably including the tractor's 12 hydraulic pump. If the self-unloading spreader 10 is self-powered it would have to include an hydraulic pump. The hydraulic pump sends hydraulic fluid to an hydraulic drive system 35 and back to the hydraulic pump through a pair of hydraulic lines 36. The hydraulic drive system 35 includes a mechanism to turn the flow of hydraulic fluid into rotational energy of a drive shaft 37 which in turn, through a gear and chain reduction system 38, drives the auger 30. The hydraulic drive system 35 should be bi-directional based upon the flow of the hydraulic fluid so it can rotate the auger 30 in either direction. This way if something becomes stuck between the auger 30 and the bottom 26 or side walls 24 and 25 of the container 20 while the auger 30 is moving material, an operator can reverse the flow direction of the hydraulic fluid and thereby reverse the rotation direction of the auger 30 to dislodge the stuck material.

Inside of the container 20, above the auger 30 is an adjustable height baffle 34. Depending upon the flowability of the material to be dispersed, the operator can adjust the baffle 34 height up or down to control the amount of material the auger 30 has available to move. The operator would adjust the baffle 34 lower for heavier materials like dry sand or small stone, mid-level for mid-weight materials like moist topsoil and higher for lighter materials like mulch and other types of similar materials. Adjusting the height of the baffle 34 helps the auger from getting access to too much heavy material at one time, and thereby being unable to move, or getting access to too little light material.

Figure 5:
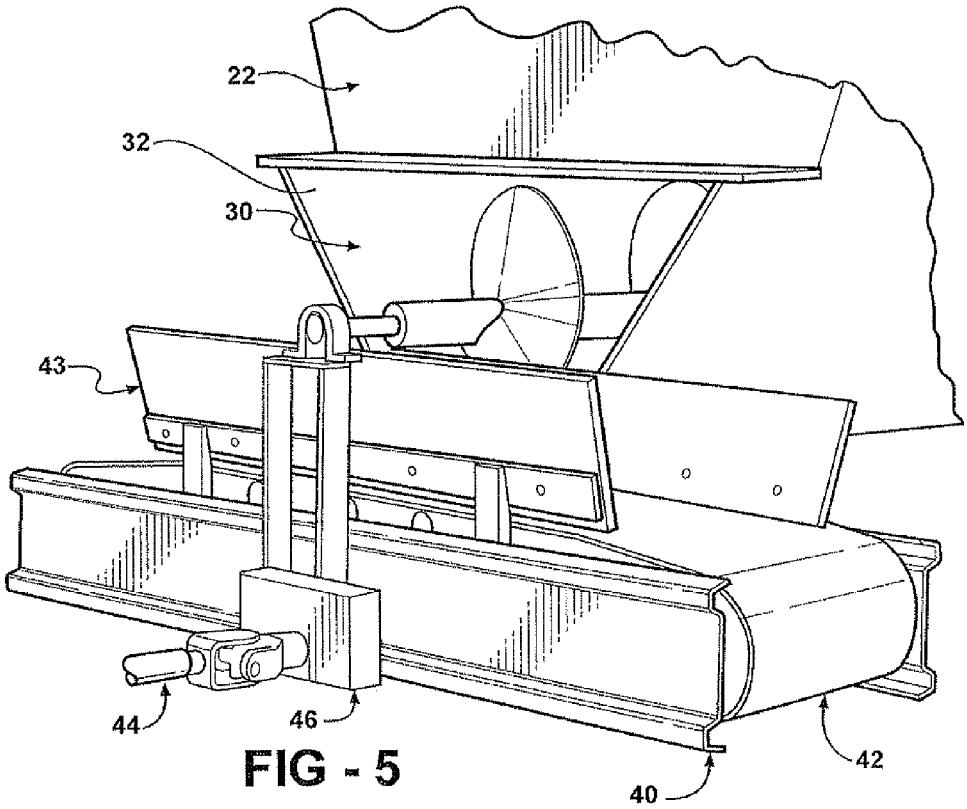
FIG. 5 is a perspective, close-up view of the front side of the front-end conveyer system embodiment of the improved self-unloading spreader of the present invention showing the conveyer system, the opening and the auger.

The self-unloading spreader 10 also includes an independently-controllable material spreading/throwing system 40 to spread/throw material that flows through the opening 32. In the illustrated embodiment the material spreading/throwing system 40 includes a conveyer belt 42 to spread/throw material and is attached to the frame 14 near the opening 32. However, the material spreading/throwing system 40 could be any throwing system that throws the material from the spreader, such as a spinning disk system or a chute system. Also, in the illustrated embodiment the material spreading/throwing system 40 is attached near the front end wall 22, as shown in FIG. 2, though the material spreading/throwing system 40 could be attached near the rear end wall 23 if the opening 32 was in the rear end wall. A shield 43 attached to the side of the material spreading/throwing system 40 opposite the opening 32 helps prevent material from falling off of the side of the conveyer belt 42. Material spreading/throwing system 40 is driven by a power-take-off system (PTO) 44, again preferably from the tractor 12 though it may be from a system integral to the self-unloading spreader 10 if the self-unloading spreader 10 is self-powered. The PTO 44 connects to a gear box system 46 of material spreading/throwing system 40. Since a PTO 44 can only rotate in one direction the gear box system 46 adjusts the direction of rotation to allow the material spreading/throwing system 40 to drive the conveyer belt 42 in either direction, as shown in FIG. 5. This allows the self-unloading spreader 10 to spread material to either the right side of the spreader 10 or the left side of the spreader 10 with only having to adjust the gear box system 46. The operator would not have to physically detach, move and reattach any part or parts of the spreader 10 nor would the operator have to turn the entire spreader 10 around to spread material in the opposite direction.

Figure 7:
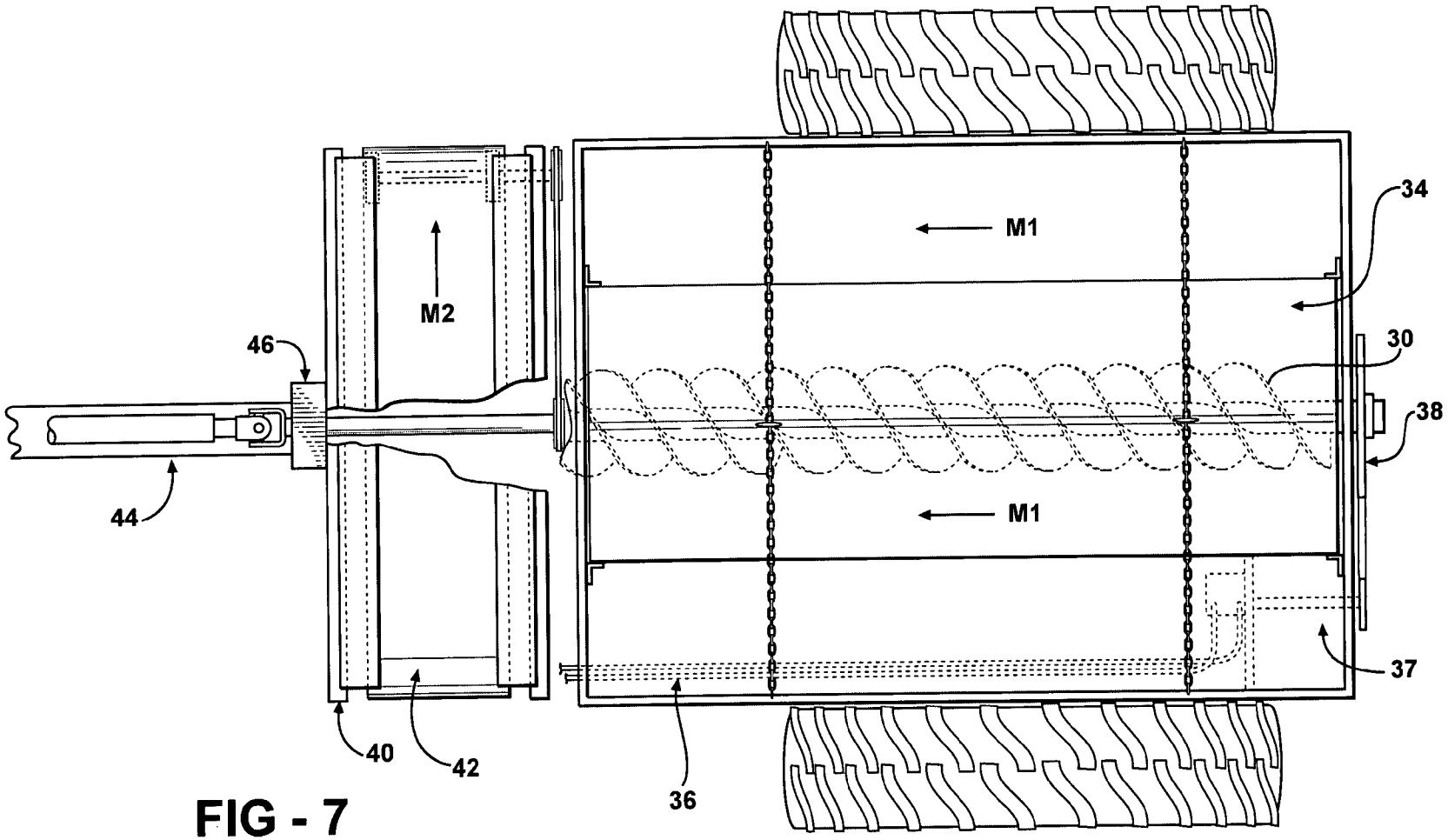
FIG. 7 is a top view of the front-end conveyer system embodiment of the improved self-unloading spreader showing the flow of the material to be spread.

FIG. 7 shows the flow of material when the self-unloading spreader 10 is in operation. The auger 30 moves the material towards the front end wall 22 of the box and out through the opening 32 as shown by arrows M1. The adjustable height baffle 34 keeps too much material from getting to the auger. The material flows through the opening 32 and lands on the conveyer belt 42 of the conveyer belt system 40. In FIG. 7 the material spreading/throwing system 40 throws the material to the right, as shown by arrow M2 spreading it to the right side of the self-unloading spreader 10 though the material spreading/throwing system 40 could just as easily throw the material to the left and thereby spread the material to the left side of the self-unloading spreader.

The operator can independently control the speed of the auger 30 through the hydraulic system and the material spreading/throwing system 40 through the PTO 44. By starting, stopping or reversing the rotation of the auger 30 through adjustments of the hydraulic system as well as adjusting the height of the baffle 34 the operator can choose the flow rate of the material through the opening 32 to the spreading/throwing system 40 to be spread. The flow rate of the material through the opening 32 is greater if the auger 30 is moving material towards the opening 32 and the adjustable height baffle 34 is adjusted to a higher height which allows the auger access to more material to move. The flow rate of the material through the opening 32 is less if the auger 30 is not moving material towards the opening 32—for instance if the auger 30 is stopped or is reversing its rotation—and/or the adjustable height baffle 34 is adjusted to a lower height. The distance the conveyer belt 42 throws the material is dependent upon the rotation speed of the PTO 44 and therefore is dependent upon the speed of the tractor's 12 engine. To disperse the material closer to the self-unloading spreader 10, the operator slows the speed of the tractor 12 engine and thereby slows the PTO 44. This slows the rotation of the conveyer belt 42 on the material spreading/throwing system 40 and the material is spread closer to the self-unloading type spreader 10, as shown in FIG. 1, item S. To disperse the material farther from the self-unloading spreader 10, the operator increases the speed of the tractor 12 engine. This increases the rotation of the conveyer belt 42 on the material spreading/throwing system 40 and the material is spread farther from the self-unloading type spreader 10, as shown in FIG. 1, item L.

Having the auger 30 powered by the hydraulic system and the material spreading/throwing system 40 powered by the PTO 44 allows the operator to independently adjust how much material the self-unloading spreader spreads in a given time and how far the self-unloading spreader throws the material without the operator having to move from the seat of the tractor 12. For instance, the operator could adjust the baffle 34 height and keep the auger 30 rotating to provide a higher flow rate of material to spread while running the tractor 12 engine slowly, thereby running the PTO 44 slowly which would make the conveyer belt 42 throw material closer to the self-unloading spreader 10. This would spread a large amount of material over a smaller area close to the self-unloading spreader 10. Conversely, the operator could adjust the auger's 30 rotation and/or the baffle's 34 height to provide a lower flow rate of material to spread to the conveyer belt 42 while keeping the tractor's 12 engine speed high thereby throwing material farther from the self-unloading type spreader. This would spread less material over a larger area. In the same way a higher flow rate of material from the auger 30/baffle 34 combination and a higher PTO 44/conveyer system 40 speed would spread a medium amount of material over a larger area and a lower flow rate of material from the auger 30/baffle 34 combination and a lower PTO 44/conveyer system 40 speed would spread a medium amount of material over a smaller area.

In addition, the operator could choose which gear speed in which he would operate the tractor, thereby increasing (for higher gears) or decreasing (for lower gears) the speed of the tractor 12 for a given engine speed. A higher tractor 12 speed from a higher gear for a given engine speed would, all other adjustments being equal, spread material more thinly over the ground. A lower tractor 12 speed from a lower gear for a given engine speed would, again all other adjustments being equal, spread material more thickly over the ground. The rotation of the auger 30, the speed of the engine/PTO 44 and the speed of the tractor 12 based upon the gear selection allows the operator the choice of three separate inputs to adjust to spread material more thickly or thinly and nearer or farther from the self-unloading spreader 10 without having to move from the seat of the tractor 12. The only time the operator would have to move from the tractor 12 to make an adjustment would be to adjust the height of the baffle 34, and the baffle 34 height tends to remain the same when working with the same material to be spread. The only time an operator would tend to adjust the height of the baffle is when the operator begins to spread a different material.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A self-unloading material dispensing device for use in selectively depositing material in a selectively variable target area away from the device, the dispensing device comprising:

a container having a front end wall defining an opening, a rear end wall, elongate opposing side walls extending angularly inward toward a longitudinal axis defined by the front and rear walls and a bottom;

a rotatable circular auger positioned in the container along the longitudinal axis in substantial alignment with a path of travel of the device for selected movement of material in the container along the longitudinal axis from the container through the opening in the front end wall;

a bi-directional continuous loop linear conveyer positioned outside of the container transverse to the longitudinal axis adjacent the opening in the front end wall, the conveyer receiving material passed through the front end wall opening for selected projection of the material in a direction away from a selected one of the side walls of the container to a targeted area for deposit of the material; and a first variable speed power source to drive the auger and a second independent variable speed power source to drive the conveyer for the selected projection of the material to the selectively variable target area.

2. The device of claim 1 wherein the first power source comprises a hydraulic source and the second power source comprises a power take off.

3. A self-unloading trailer for use with a vehicle which forceably moves the trailer along a path of travel, the trailer comprising:

a container having a front wall defining an opening adjacent the vehicle, a rear wall opposite the front wall defining a longitudinal axis of the container substantially parallel to the path of travel, and opposing side walls angled inward toward the longitudinal axis positioned between the front and rear walls;

a rotatable circular auger positioned between the angled side walls along the longitudinal axis of the container in substantial alignment with the path of travel, a portion of the auger urging the material toward the vehicle extending through the front wall opening;

a linear continuous loop conveyer belt positioned outside of the container adjacent the front wall opening directly below the portion of the auger extending through the opening and transverse to the longitudinal axis of the container;

a first independent hydraulic power source for selectively driving the auger and a second independent power take off source from the vehicle of a different type than the first power source for selectively driving the conveyer;

wherein the first power source independently rotates the auger moving material through the container along the longitudinal axis and the vehicle path of travel through the opening for deposit onto the conveyer whereby the second power source independently drives the conveyer to rapidly project the material off of the conveyor from a selected one of the side walls for deposit to a selected and variable target away from the selected side wall.

4. The device of claim 3 wherein the targeted area is a row substantially parallel to the path of travel while the device is in motion along the path of travel.

5. The trailer of claim 4 wherein substantially no material is deposited between the selected side wall and the selected target.

6. The trailer of claim 3 wherein each of the independent first and the second power sources are variable speed sources.

7. The trailer of claim 3 further comprising a baffle positioned substantially along the path of travel for controlling the amount of material passing the auger.

8. The trailer of claim 3 wherein the deposit of material is a selected and discrete amount of material.

9. The trailer of claim 3 wherein the front wall further comprises a flanged shoot extending along the path of travel and defining the opening in the front wall, the flanged shoot at least partially surrounding the portion of the auger passing through the opening and urging the material toward the vehicle.

10. A self-unloading material dispensing device for use in depositing material in a direction transverse to a path of travel of the device, the device comprising:

a powered vehicle moveable along a path of travel;

a trailer connected to the vehicle for movement of the trailer along the path of travel, the trailer having a container having a front wall adjacent the vehicle defining an opening, a rear wall opposite the front wall defining a longitudinal axis of the container substantially parallel to the path of travel, and opposing side walls angled inward toward the longitudinal axis positioned between the front and rear walls;

a rotatable circular auger positioned between the angled side walls along the longitudinal axis of the container in substantial alignment with the path of travel and having a exit flight extending through the opening;

a linear continuous loop conveyer belt positioned outside of the container adjacent the opening in the front wall and positioned below the auger and transverse to the longitudinal axis of the container;

a first independent variable speed hydraulic power source for selectively driving the auger and a second independent variable speed power take off source for selectively driving the conveyer, the first and second power sources are simultaneously operable;

a baffle positioned in the container in substantial alignment with the longitudinal axis for controlling the gravity fed flow of material to the auger;

wherein the first power source independently rotates the auger moving material through the container along the longitudinal axis and the vehicle path of travel through the opening for deposit onto the conveyer whereby the second power source independently drives the conveyer to rapidly project the material off of the conveyor from a selected one of the side walls for deposit to a selected and variable distance target away from the selected side wall.

11. The device of claim 10 wherein a portion of the auger positioned along the path of travel extends through the front end wall opening and is positioned directly above the transversely positioned linear conveyor.

12. The device of claim 11 wherein the front wall further comprises a flanged shoot extending along the path of travel and defining the opening in the front wall, the flanged shoot at least partially surrounding the portion of the auger passing through the opening.

13. The device of claim 11 further comprising at least one shield positioned below the portion of the auger extending through the opening to guide material from the auger onto and along the conveyor.

* * * * *